United States Patent [19]

Ringer

[11] Patent Number: 4,687,163

[45] Date of Patent: Aug. 18, 1987

[54] RAILWAY SWITCH CONTROL SYSTEM

[75] Inventor: Thomas R. Ringer, Gloucester, Canada

[73] Assignee: Canadian Patents and Development Limited, Ottawa, Canada

[21] Appl. No.: 639,414

[22] Filed: Aug. 10, 1984

[30] Foreign Application Priority Data

Sep. 23, 1983 [CA] Canada ..... 437465

[51] Int. Cl.[4] ..... E01B 7/24

[52] U.S. Cl. ..... 246/428; 126/271.2 B; 219/213; 219/486; 219/499; 219/511

[58] Field of Search ..... 246/218, 428; 219/499, 219/213, 208, 209, 210, 486, 497, 511; 104/279; 126/271.2 B; 323/366, 369; 338/28

[56] References Cited

U.S. PATENT DOCUMENTS

| | | | |
|---|---|---|---|
| 2,644,657 | 7/1953 | White, Jr. | 246/428 |
| 2,806,118 | 9/1957 | Peterson | 219/499 X |
| 3,102,689 | 9/1963 | Ditto | 219/499 X |
| 3,275,802 | 9/1966 | Vandivere et al. | 219/499 |
| 3,312,820 | 4/1967 | Watkins | 246/428 |
| 3,586,829 | 6/1971 | Farmer et al. | 219/499 X |
| 3,733,463 | 5/1973 | Low et al. | 219/499 |
| 3,818,184 | 6/1974 | Habfast et al. | 219/499 X |
| 3,828,332 | 8/1974 | Rekai | 219/511 X |
| 3,946,200 | 3/1976 | Juodikis | 219/499 |
| 3,974,993 | 8/1976 | Hammecke | 246/428 |
| 4,056,708 | 11/1977 | Soodak et al. | 219/499 |
| 4,195,805 | 4/1980 | Keep, Jr. | 246/428 |
| 4,277,672 | 7/1981 | Jones | 219/499 X |
| 4,324,184 | 4/1982 | Sullivan | 246/428 X |
| 4,333,004 | 6/1982 | Forgue et al. | 219/499 X |

*Primary Examiner*—Randolph A. Reese
*Assistant Examiner*—Edward M. Wacyra
*Attorney, Agent, or Firm*—R. William Wray & Associates

[57] ABSTRACT

A control switch system for a railway switch heater with an environment probe near the switch and controlling switching on and off of the switch heater in a predetermined mode.

2 Claims, 5 Drawing Figures

RAILWAY SWITCH CONTROL SYSTEM

BACKGROUND OF THE INVENTION

This invention relates to improvements in the control of heating devices. It is particularly concerned with the control of a heater for a railway track switch.

In my U.S. Pat. No. 3,972,497, issued Aug. 3, 1976, I describe apparatus for producing snow deflecting air currents for a railway switch. As stated therein, in the winter operation of railway systems the failure of railway track switches due to the presence of snow is a well known problem. Railway track switches are presently protected against failure from snow or ice by manual cleaning and by thermal methods, e.g. electrical heating, and by combustion heating.

Many railway switches use oil or gas fired burners to provide heated air for maintaining the switch points clear of snow and ice. The burners may be controlled locally by a snow detector or remotely by a dispatcher often located many miles from the site of the switch where environmental conditions may be very different.

In. U.S. Pat. No. 3,439,161, issued Apr. 15, 1969 to L. A. McElwee et al, a railway switch heater is described together with a rail temperature sensor to provide an indication of the temperature of the rails which indication may be so used that when the rails are sufficiently heated assuring proper operation of the switch, the heater may be shut off.

Experiments with a rail temperature sensor have indicated that control is not adequate when one is concerned with the snow and ice problems which are normally encountered during winter operation of a railway. Furthermore, reliance on the temperature of a rail alone may well result in the heater being switched on when there is no accumulation of snow and ice to prevent operation of the railway switch. Thus an appreciable wastage of fuel may result.

SUMMARY OF THE INVENTION

According to the present invention there is provided a railway switch heating system including:

(a) first heating means for providing heat in the region of said railway switch, (b) switching means for switching said first heating means off and on, (c) probe means located near said railway switch, (d) temperature sensing means forming one arm of a measuring bridge and having a characteristic whose value is proportional to the temperature of said probe means, (e) second heating means to provide heat to said probe means to maintain its temperature substantially constant.

(f) control means for controlling the electrical power supplied to said second heating means to maintain the probe temperature substantially constant, (g) means responsive to said control means to cause said switching means to switch said heating means off and on in a predetermined mode.

BRIEF DESCRIPTION OF THE DRAWINGS

An embodiment of the invention will now be described, by way of example, with reference to the accompanying drawings in which.

DESCRIPTION OF AN EMBODIMENT OF THE INVENTION

Figure 1:
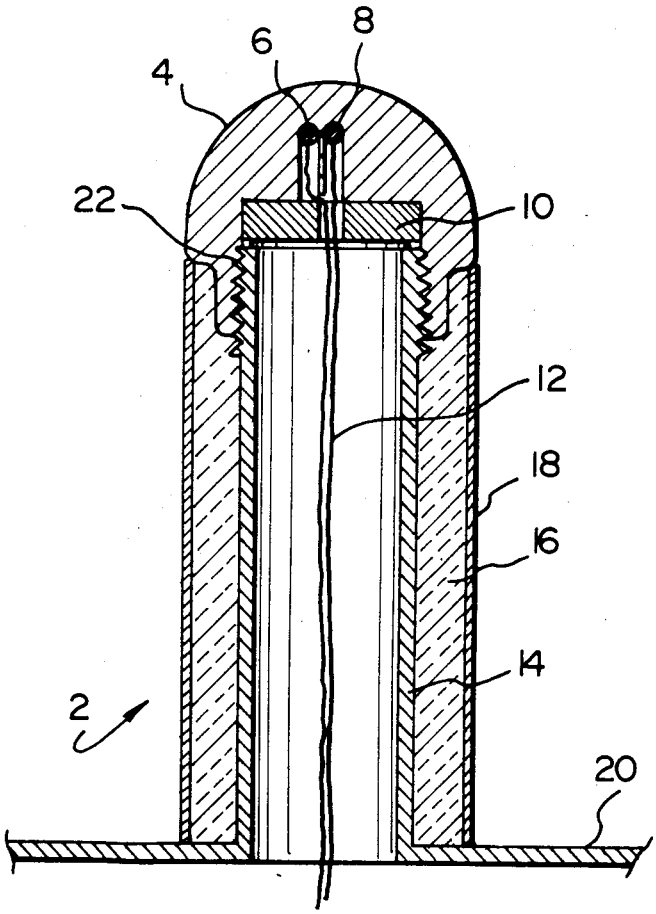
FIG. 1 is a diagrammatic, partly cross-sectional, view of a heat rate probe unit.

Referring to FIG. 1, a heat rate probe unit 2 is illustrated and, in practice, is located in the region of the railway switch (not shown) which is provided with heat from a combustion heater (not shown). Thus, the heat loss of the probe approximates the heat loss of the railway switch.

The probe unit 2 includes a sensor head 4 exposed to the outside environment in the region of the railway switch, a first thermistor 6 and a second thermistor 8 within said head 4 with a ten watt button heater 10 located in a pocket in the head so as to provide heat to the head 4. The two thermistors are installed within 3 mm. of the head surface and thermistor 6 is used as a surface temperature sensing element in the circuit of the temperature control unit (see FIG. 2) whilst thermistor 8 enables the performance of said temperature controller to be monitored. Thermistor 8 also serves as a spare for the control operation and is not initially connected in the electrical circuit.

One of the thermistors 6 and 8 is connected by leads 12 to other circuits described below, leads 12 passing through a stainless steel support tube 14. This is surrounded by insulating material 16 contained within an aluminum sleeve 18. The support tube 14 continues in a flange or mount portion 20. The upper surface of the flange portion 20 is shown as flat but it may, of course, be omitted. The top surface of head 4 may be roughed or otherwise changed so as to ensure better retention of snow when it lands thereon. With a flat polished surface snow particles have a tendency, in practice, to bounce off so that an incorrect reading of climatic environmental conditions may result.

It will be seen from FIG. 1 that the head 4 is provided with screw threads 22 so as to be sealingly attached to, and readily removable from, the support 14.

Figure 2:
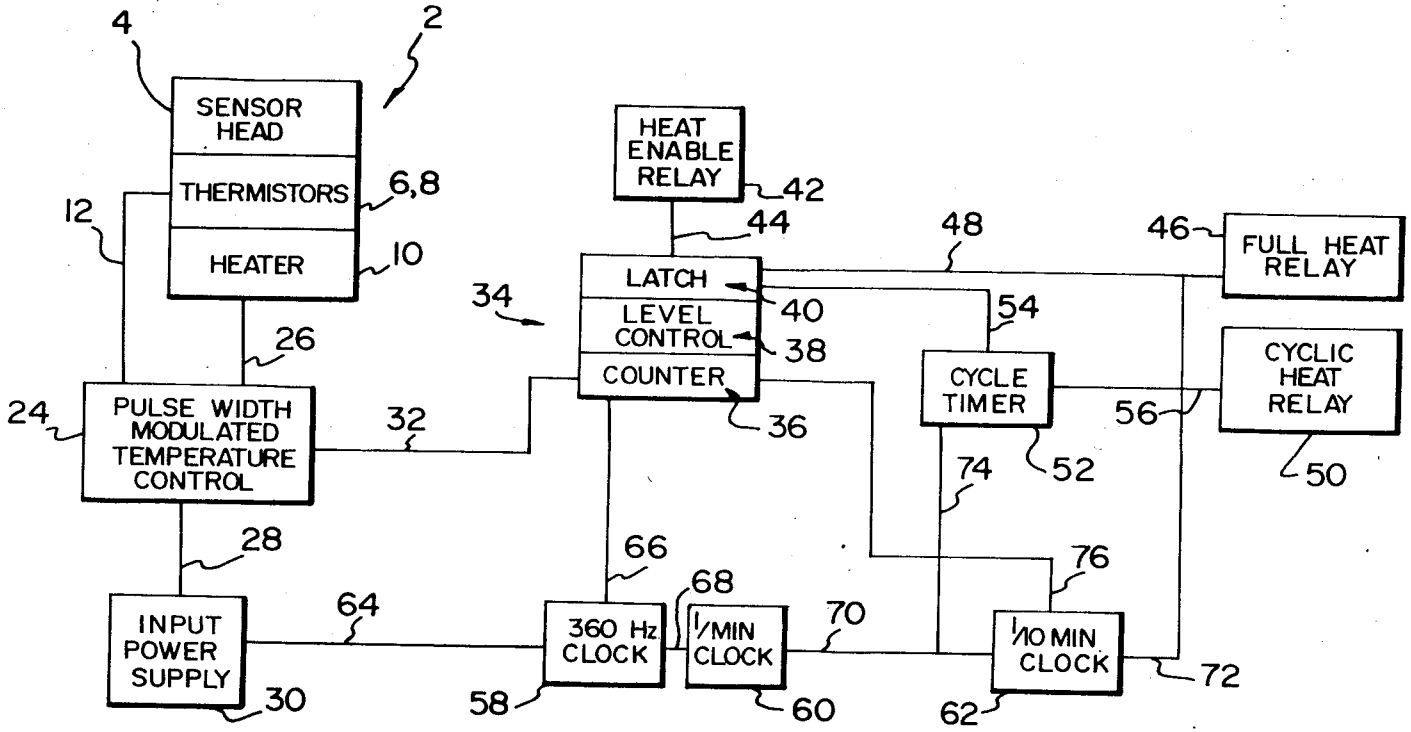
FIG. 2 is a block schematic diagrammatic representation of the electronic circuits associated with the probe unit of FIG. 1.

Referring to FIG. 2, the various parts of the probe unit 2 are illustrated in block form.

The respective thermistor 6 or 8 is connected through thermistor leads 12 to a unit 24 identified as a pulse width modulated temperature control unit. Heater 10 is controlled by the same unit 24 by way of leads 26. Control unit 24 is itself supplied with power through connection leads 28 from an input power supply unit 30 and is also connected through connection leads 32 to a unit 34 incorporating therein a counter unit 36, level control unit 38 and a latch unit 40. A heat enable relay unit 42 is connected through leads 44. A full heat relay 46 is connected to unit 34 through leads 48 whilst a cyclic heat relay 50 is connected through cyclic timer unit 52 and leads 54 and 56. Timing pulses are provided by a 360 Hz clock unit 58, a one minute clock timer unit 60, and a one-tenth minute clock timer unit 62 with associated leads 64, 66, 68, 70, 72, 74 and 76.

Figure 3:
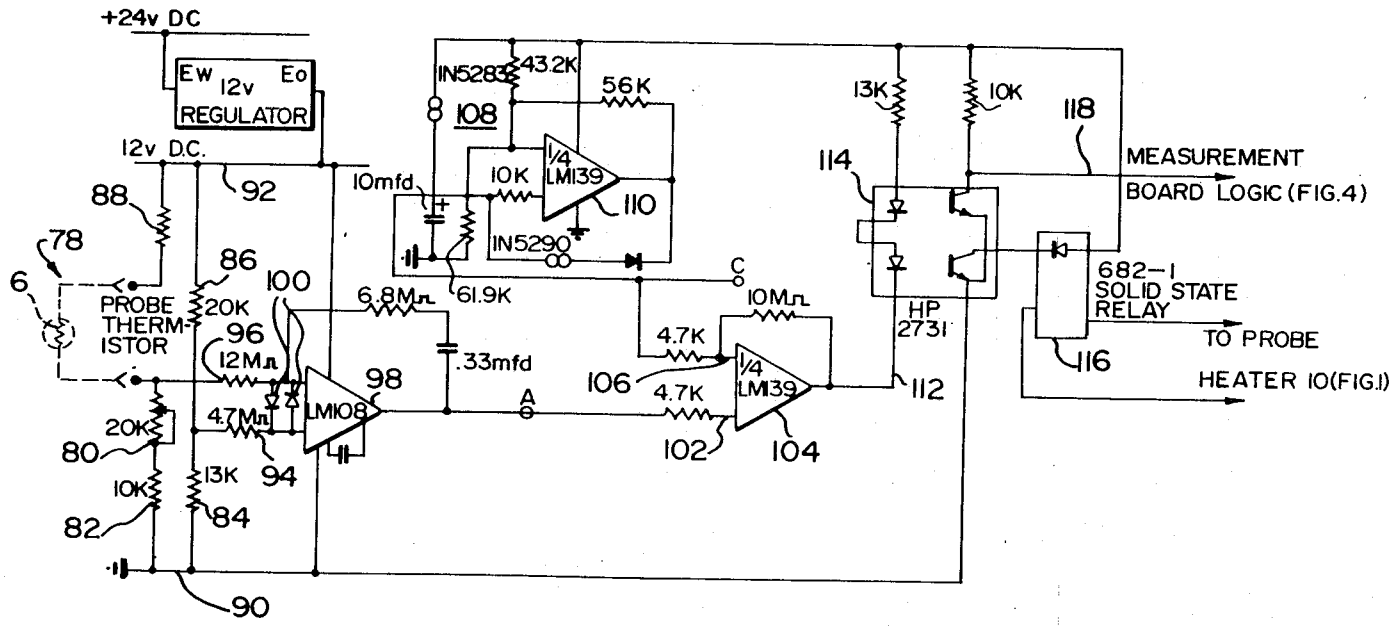
FIG. 3 is a diagrammatic representation of the temperature control unit.

FIG. 3 is a diagrammatic representation of the board logic of the temperature control unit 24 of FIG. 2.

The probe thermistor 6 (FIG. 1) is connnected in one arm of a bridge network whilst the second thermistor 8 is not connected in circuit but is available as a spare, as mentioned above.

The control point of the full bridge input circuit 78 is set by a potentiometer 80 in FIG. 3. Resistors 80, 82, 84, 86, and 88 form part of the bridge circuit which is connected between a ground potential line 90 and a positive 12 volt D.C. line 92.

Any unbalance in bridge 78 is detected and fed as a bridge error signal through resistors 94 and 96 to the input of an LM108H amplifier circuit 98, whose input is protected by back-to-back diodes 100. The output of amplifier circuit 98 is supplied as one input 102 of a first comparator section 104 of an LM139 comparator, whilst the other input 106 of comparator section 104 is obtained from a triangular waveform generator 108 with a D.C offset. This triangular waveform generator 108 incorporates the second comparator section 110 of the LM139 comparator and two constant current diodes.

As will be appreciated, the resultant output of the first comparator section 104 is dependent on the instantaneous relationship between the voltage of the waveform generator and the output of the integrating amplifier 98. It takes the form of pulses whose width is a function of the bridge (78) error signal.

The resultant pulse output of comparator section 104 is fed along line 112 to control the operation of a HP 2731 Dual Optical Coupler Unit 114. One half of Dual Optical Coupler Unit 114 switches a solid state relay 116 controlling the button heater 10 (FIG. 1) whilst the other half provides a logic input along line 118 to a measurement board.

Figure 4:
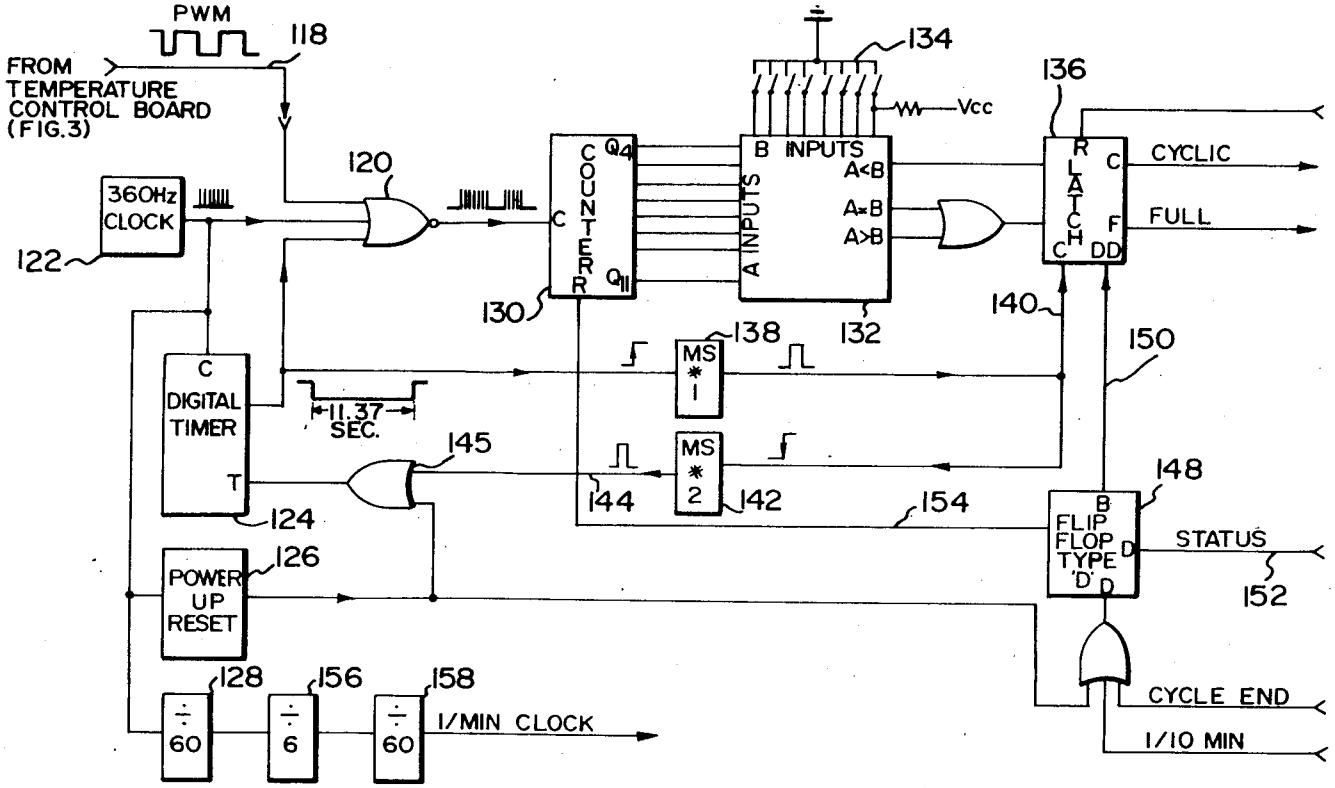
FIG. 4 is a diagrammatic representation of the measurement and mode selection unit.

In FIG. 4 the measurement and mode selection board logic is diagrammatically illustrated. Pulses from line 118 (FIG. 3) are fed along line 118 (FIG. 4) to one input of a 3-input NOR gate unit 120. According to this embodiment of the invention, at temperatures near 0° Celsius the width of the pulse received from the temperature control unit (FIGS. 1 and 3) on line 118 is narrow due to the low heat requirement of the Heat Transfer Rate Probe (FIGS. 1 and 2) to bring its temperature up to the required operating temperature of the railway switch. The pulse occurs in this embodiment at a nominal frequency of 1 Hz. However, to obtain better resolution of the heat requirement it was decided to use a higher frequency clock gated by the logic pulses received from the temperature controller and to integrate the number of clock pulses over a period of time. Thus a clock frequency of 360 Hz was selected with an integration time of 11.37 seconds.

Referring to FIG. 4, the free-running 360 Hz clock unit 122 supplies clock pulses to a second input of the three input NOR gate 120, to the third input of which is fed the output of a digital timer unit 124. The clock pulses from clock pulse unit 122 are fed to an input of the digital timer unit 124 as well as to a power-up-reset unit 126 and a Divide-by-60 unit 128.

Digital Timer unit 124 provides a 11.37 second integration period by using the 360 Hz clock pulse unit 122 as its own internal clock and providing an output pulse equal to 4096/360 seconds. It will be seen that the pulses on line 118 and from digital timer unit 124 act to gate the clock pulses from unit 122. Thus the output of gate 120 consists of bursts of clock pulses which are accumulated in a 14-bit binary counter unit 130 within the counter unit 36 of FIG. 2.

Counter outputs Q4 to Q11 from binary counter unit 130 are fed to the A inputs of an 8-bit magnitude comparator unit 132 whose B inputs are set by 8 single pole switches 134. The B inputs are the set point upon which the decision is made to select either the full or cyclic mode of the heater (FIGS. 1 and 2), and the output of the magnitude comparator unit 132 is stored in a quad latch unit 136. This is achieved by a first monostable unit 138 which provides a pulse along line 140 to an input of quad latch unit 136 and is triggered by the trailing edge of a pulse from the digital timer unit 124. The trailing edge of the pulse from nonostable unit 138 is also used to trigger a second monostable unit 142 whose output on line 144 is utilized for three functions: (a) to reset the 14 bit counter unit 130 (b) to re-trigger the digital timer unit 124 through a two-input gate unit 145 and (c) to provide a clock pulse for a type D flip-flop unit 148. The output of flip-flop unit 148 is used to control the data disable line 150 of the quad latch unit 136.

Figure 5:
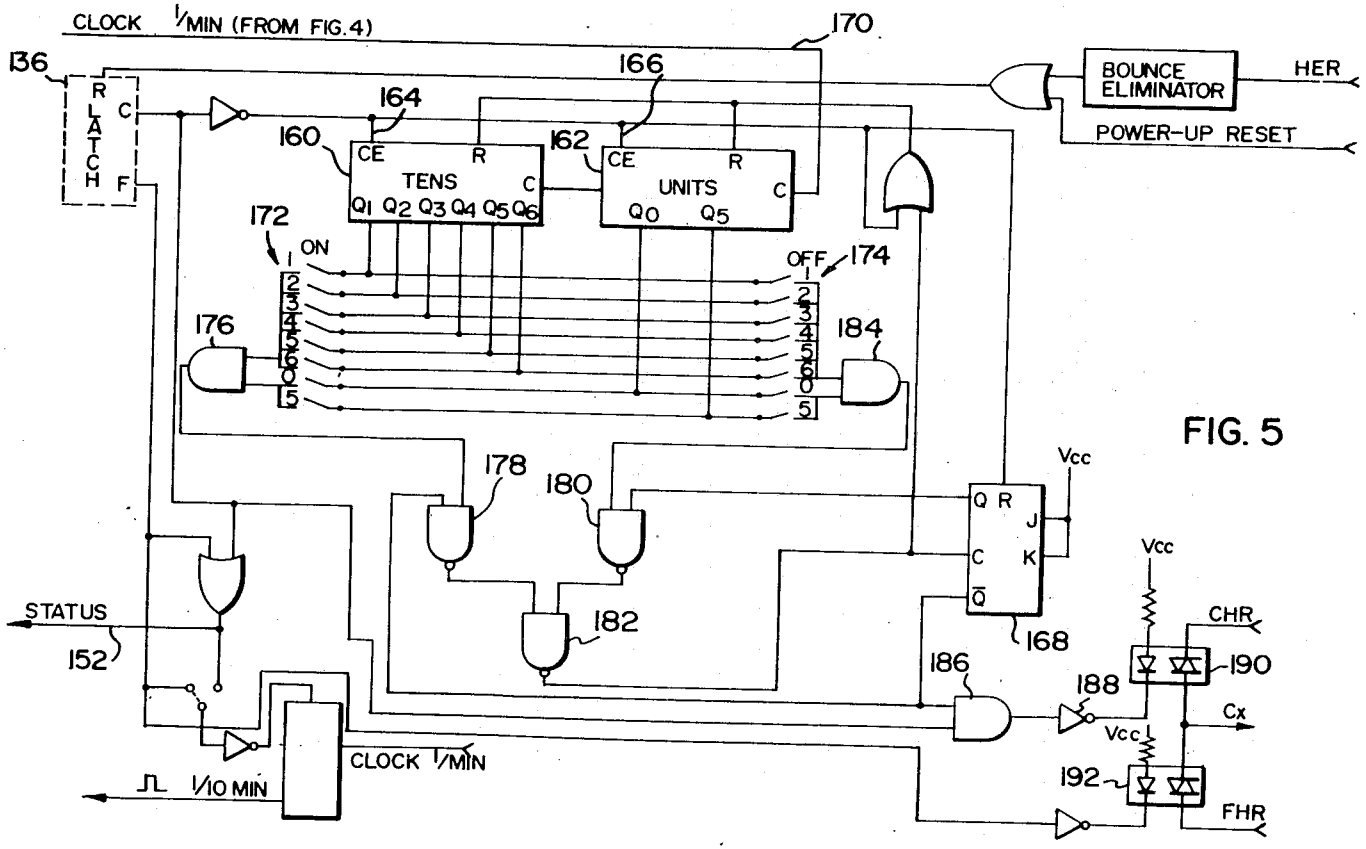
FIG. 5 is a diagrammatic representation of the cyclic timer unit.

From the above it will be seen that the circuit of FIG. 4 operates in a cyclic manner. Each time a gating pulse from digital timer 124 is fed to gate 120, a series of clock pulses is fed through counter 130 and the accumulated representative magnitude determined in comparator unit 132. At a selected time, see below, the magnitude comparator status is entered into the latch unit. This status determines whether the full cycle of operation of the heater 10 (FIGS. 1 and 2) is selected or, alternatively, only the ON-OFF cycle is selected for the heater. The selection would be made every 11.37 seconds, or twice that, due to the period of digital timer 124 and would be repeated continuously. However in the constructed embodiment it was found that the 11.37 second cycle time was extremely short when compared with the times involved with the operation of the railway switch heater (not shown). Thus it was arranged that the status of the magnitude comparator unit 132 was only entered into the latch unit 136 at 10 minute intervals or at the end of a cyclic period, the interval being selected by a link on the cyclic timer board (FIG. 5).

Updating of the latch unit 136 is achieved by resetting the Type D flip-flop unit 148 with a pulse on line 152 from the cyclic time board (FIG. 5) so as to enable the data disable line 150 of the latch unit 136. This allows the output of monostable unit 138 to be operative on line 140 to permit the current status of magnitude comparator unit 132 to be entered into latch unit 136. The second monostable unit 142 is activated by the trailing edge of the output pulse from the first monostable unit 138 and this resets the counter unit 130, retriggers the digital timer unit 124 and also causes the data input line 154 of flip-flop unit 148 to be high. Flip-flop unit 148 then flops to dis-enable line 150 and inhibits any further entry of data into latch unit 136 from comparator unit 132 until such time as the flip-flop unit 136 is again reset.

The choice of 360 Hz for the free running clock unit 122 permitted easy division to obtain one per minute pulses for use by both the cyclic and update timers. The division is obtained by three MC 14566 Industrial Time Base Generator Circuits, units 128, 156 and 158.

An MC 14541 Oscillator/Timer unit 126, is configured to provide a pulse when power is applied to the Controller. This pulse is used to intialize, where necessary, components on the measurement and cyclic timer boards and to provide the initial trigger pulse to the MC 14536 Digital Timer unit 124 used to determine the integrating period. This trigger pulse is applied through gate 145.

To provide a choice in mode of switch heater operation a cyclic heat relay (CHR) and a full heat relay (FHR) are provided in addition to the standard heat enable relay (HER).

The cyclic timer board is diagrammatically illustrated in FIG. 5 and receives inputs from measurement and mode selection board (FIG. 4) so as to control the said relays HER, CHR and FHR (not shown). The circuit of FIG. 5 also provides the status signal on line 152 (FIGS. 4 and 5).

When the quad latch latch 136 (FIG. 4) is either in the reset mode or is in the full heat mode of operation, then decode counters 160 and 162 have their respective clock enable line 164 or 166 disabled and held in the reset mode. A JK flip-flop unit 168 is also reset.

As will be appreciated, the cyclic timer board of FIG. 5 controls the operation of the railway switch heater when the cyclic mode has been selected by the measurement board logic of FIG. 4. The two cascaded decode counters 160 and 162 utilize the one-per-minute clock pulses on line 170 to determine the "ON" and "OFF" time periods of the railway switch burner previously selected by manual switches 172 and 174. In other words when the cyclic mode is selected the clock enable and reset line are released and the decode counters start to accumulate the one-per-minute clock pulses until a value equal to a value selected by the "ON" manual switches 172 is reached. Both inputs of AND gate 176 are now true which results in NAND gates 178 and 182 changing state and the output of gate 182 toggles the flip-flop unit 168 and resets the counter units 160 and 162 to zero. The counter units now accumulate clock pulses until the value selected by the "OFF" manual switches 174 enables the inputs of AND gate 184 which causes switching of the gates 180 and 182, again toggling the flip-flop unit 168 and resetting the counters 160 and 162. This sequence is repeated as long as the cyclic mode is selected by the measurement board logic of FIG. 4.

The ovs/Q/ output of the toggle flip-flop unit 168 is "AND" gated with the cyclic output of the latch unit 136 by AND gate 186, the output of which is buffered by inverter 188. This provides the current sink for opto-isolator 190. This is a type MOC 3011 and is an optically coupled isolator with zero crossing detection for the output triac. The triac completes the coil circuit of the standard relay (not shown) used by railway companies. A similar output circuit and opto-isolator 192 are used when the full heat mode is requested by the logic circuit of FIG. 4.

Another embodiment of carrying out the invention would be to use an anemometer, a temperature sensor, and a precipitation guage. These together with appropriate analogue to digital converters and the necessary mathematical algorithims in terms of computer software would allow the integration to be made using digital means or, possibly, a microprocessor.

It will be readily apparent to a person skilled in the art that a number of variations and modifications can be made without departing from the true spirit of the invention which will now be pointed out in the appended claims.

I Claim:

1. A railway switch control system for a railway switch having a first heating means for providing heat in the region of said railway switch and switching means for switching said first heating means off and on comprising:

(a) probe means located near said railway switch, (b) temperature sensing means comprising a thermistor forming one arm of a measuring bridge network and having a characteristic whose value is proportional to the temperature of said probe means, (c) second heating means to provide heat to said probe means to maintain said probe means at a substantially constant temperature, (d) control means for controlling the electrical power supplied to said second heating means to maintain the probe temperature substantially constant, (e) means responsive to said control means to cause said switching means to switch said first heating means off and on in a predetermined mode, and (f) wherein the output of said bridge network, when unbalanced, is fed as a bridge error signal to a comparator means which provides a resultant pulse output to control the operation of said second heating means, the width of said pulse output being a function of said bridge error signal, said pulse output being aslo supplied to a measurement unit to control said first heating means to provide a full cycle of operation or an ON-OFF cycle of operation, the output of said control means being also utilized to control operation of control relays to select operation of said first heating means.

2. A railway switch control system according to claim 1 wherein:

(a) said comparator means has at least two inputs, an output of said measuring bridge being connected to a first input of said comparator means to provide said bridge error signal as an unbalanced bridge output signal thereto;

(b) a triangular waveform generator being connected to a second input of said comparator means whereby the output of the comparator means comprises pulses having a characteristic proportional to said unbalanced bridge output signal signal, and (c) means responsive to the output of said comparator means to cause said switching means to switch said first heating means off and on in a predetermined mode.

* * * * *